US010403427B2

(12) United States Patent
Oono et al.

(10) Patent No.: US 10,403,427 B2
(45) Date of Patent: Sep. 3, 2019

(54) TRANSFORMER

(71) Applicant: Hitachi, Ltd., Chiyoda-ku, Tokyo (JP)

(72) Inventors: Yasunori Oono, Tokyo (JP); Naoya Miyamoto, Tokyo (JP); Akira Yamagishi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 106 days.

(21) Appl. No.: 15/550,562

(22) PCT Filed: Feb. 3, 2016

(86) PCT No.: PCT/JP2016/053124
§ 371 (c)(1),
(2) Date: Aug. 11, 2017

(87) PCT Pub. No.: WO2016/147725
PCT Pub. Date: Sep. 22, 2016

(65) Prior Publication Data

US 2018/0040409 A1 Feb. 8, 2018

(30) Foreign Application Priority Data

Mar. 18, 2015 (JP) ..... 2015-054157

(51) Int. Cl.
*H01F 27/25* (2006.01)
*H01F 27/26* (2006.01)
(Continued)

(52) U.S. Cl.
CPC ..... *H01F 27/25* (2013.01); *H01F 3/10* (2013.01); *H01F 27/263* (2013.01); *H01F 30/10* (2013.01);
(Continued)

(58) Field of Classification Search
CPC ..... H01F 27/00–36
(Continued)

(56) References Cited

U.S. PATENT DOCUMENTS

2012/0056706 A1 3/2012 Schaefer et al.

FOREIGN PATENT DOCUMENTS

JP 57-143808 A 9/1982
JP 62-2224 U 1/1987
(Continued)

OTHER PUBLICATIONS

International Search Report (PCT/ISA/210) issued in PCT Application No. PCT/JP2016/053124 dated Apr. 19, 2016 with English-language translation (five (5) pages).
(Continued)

*Primary Examiner* — Tuyen T Nguyen
(74) *Attorney, Agent, or Firm* — Crowell & Moring LLP

(57) ABSTRACT

A transformer of the invention includes a core which includes a main leg, a side leg, and a yoke, and a winding wire (5) which is wound around the main leg of the core, inside a tank (40) which is filled with an insulating medium, the main leg of the core includes a main wound core (1) having a square cross-section which is formed by winding the amorphous magnetic ribbon and a sub wound core (2) constituted by silicon steel plates which are stacked with curvatures provided at four sides thereof, and a cross-section of a part, where the winding wire (5) is disposed, in the main leg is approximately a circular shape.

6 Claims, 7 Drawing Sheets

(51) Int. Cl.
*H01F 30/10* (2006.01)
*H01F 3/10* (2006.01)
*H01F 30/12* (2006.01)

(52) U.S. Cl.
CPC ..... *H01F 27/26* (2013.01); *H01F 30/12* (2013.01); *H01F 2003/106* (2013.01)

(58) Field of Classification Search
USPC ..... 336/65, 200, 212, 220–223, 232–234
See application file for complete search history.

(56) References Cited

FOREIGN PATENT DOCUMENTS

| | | | | | |
|---|---|---|---|---|---|
| JP | 62-238612 | A | | 10/1987 | |
| JP | 5-144646 | A | | 6/1993 | |
| JP | 3097268 | U | | 1/2004 | |
| JP | 2012-69943 | A | | 4/2012 | |
| JP | 2012069943 | A | * | 4/2012 | ..... H01F 27/266 |
| TW | I282563 | B | | 6/2007 | |
| TW | 201501142 | A | | 1/2015 | |

OTHER PUBLICATIONS

Japanese-language Written Opinion (PCT/ISA/237) issued in PCT Application No. PCT/JP2016/053124 dated Apr. 19, 2016 (four (4) pages).

Chinese-language Office Action issued in counterpart Taiwanese Application No. 10621002360 dated Sep. 29, 2017 with English Translation (4 pages).

* cited by examiner

[Fig. 1]
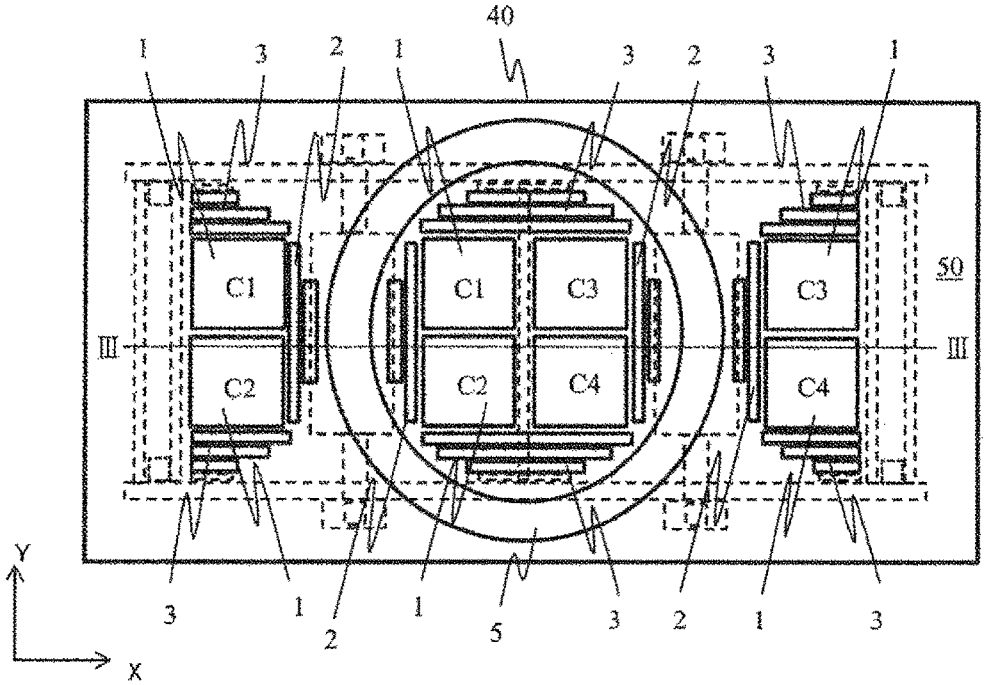

[Fig. 2]
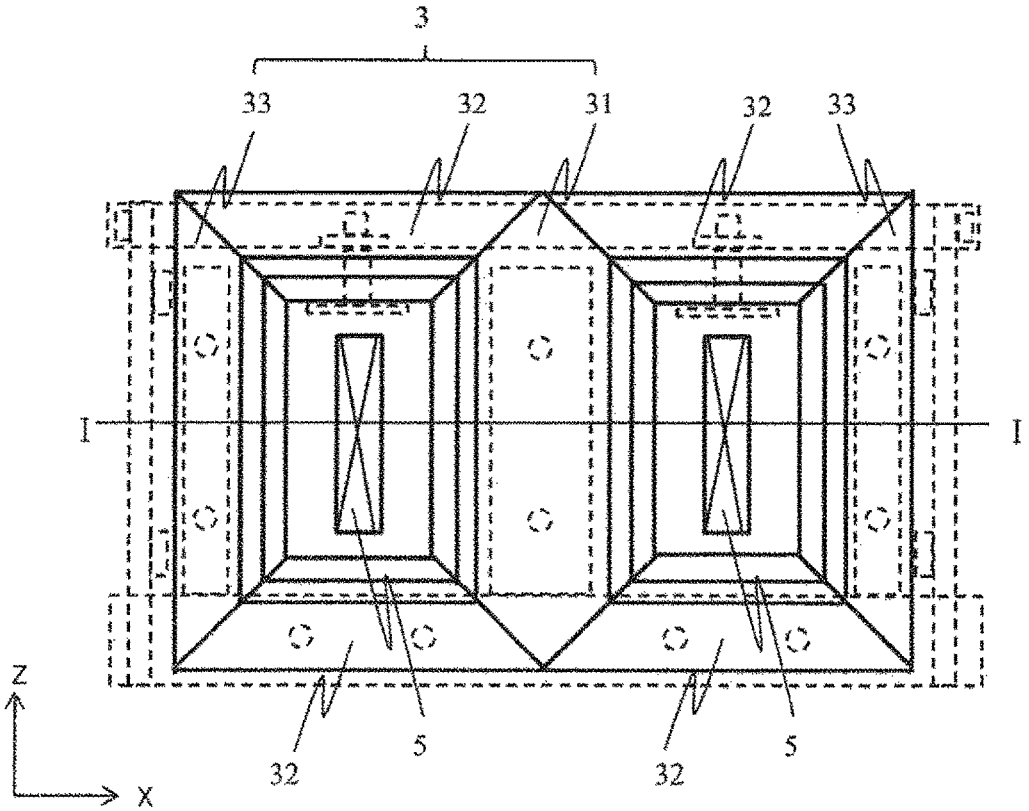

[Fig. 3]
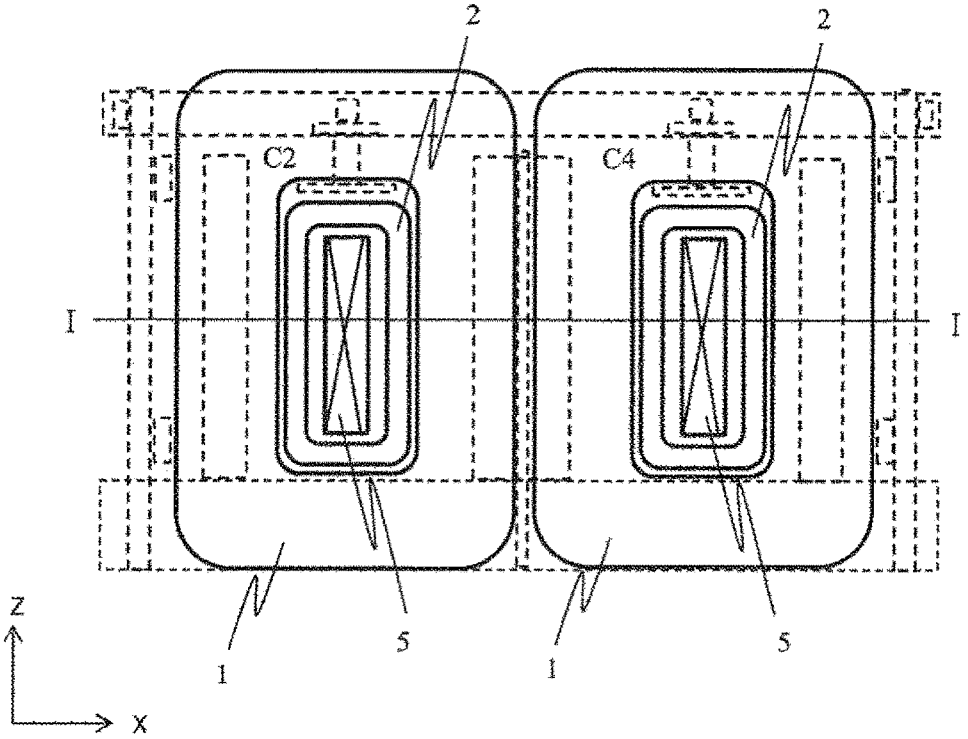

[Fig. 4]
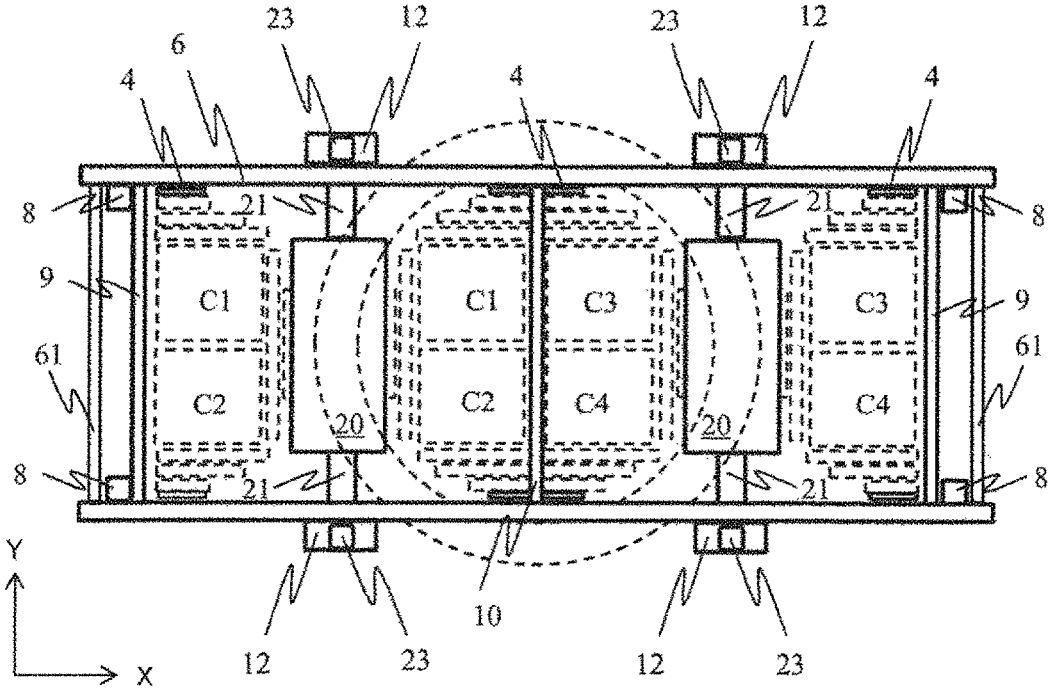
[Fig. 5]
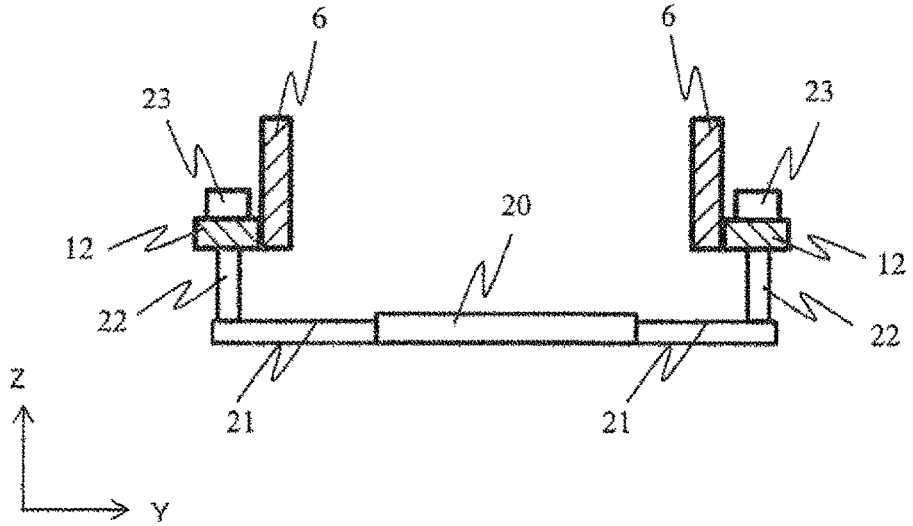

[Fig. 6]
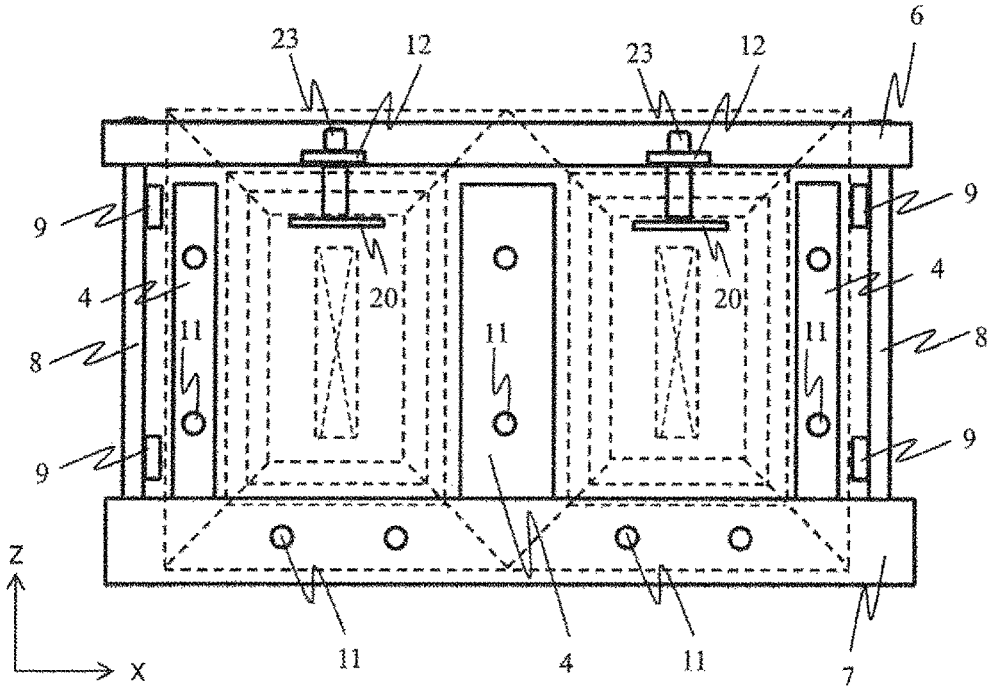

[Fig.7]
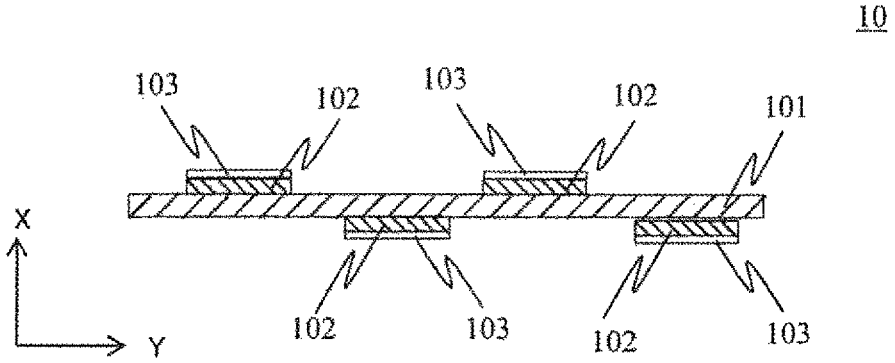
[Fig.8]
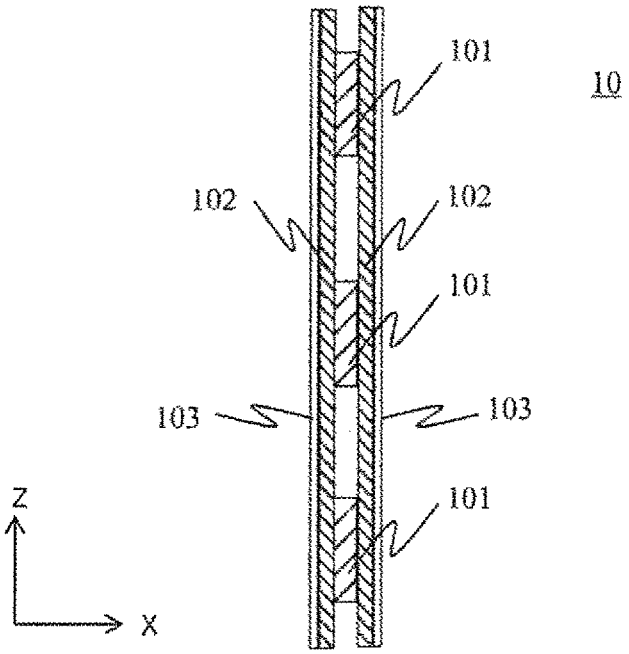

[Fig.9]
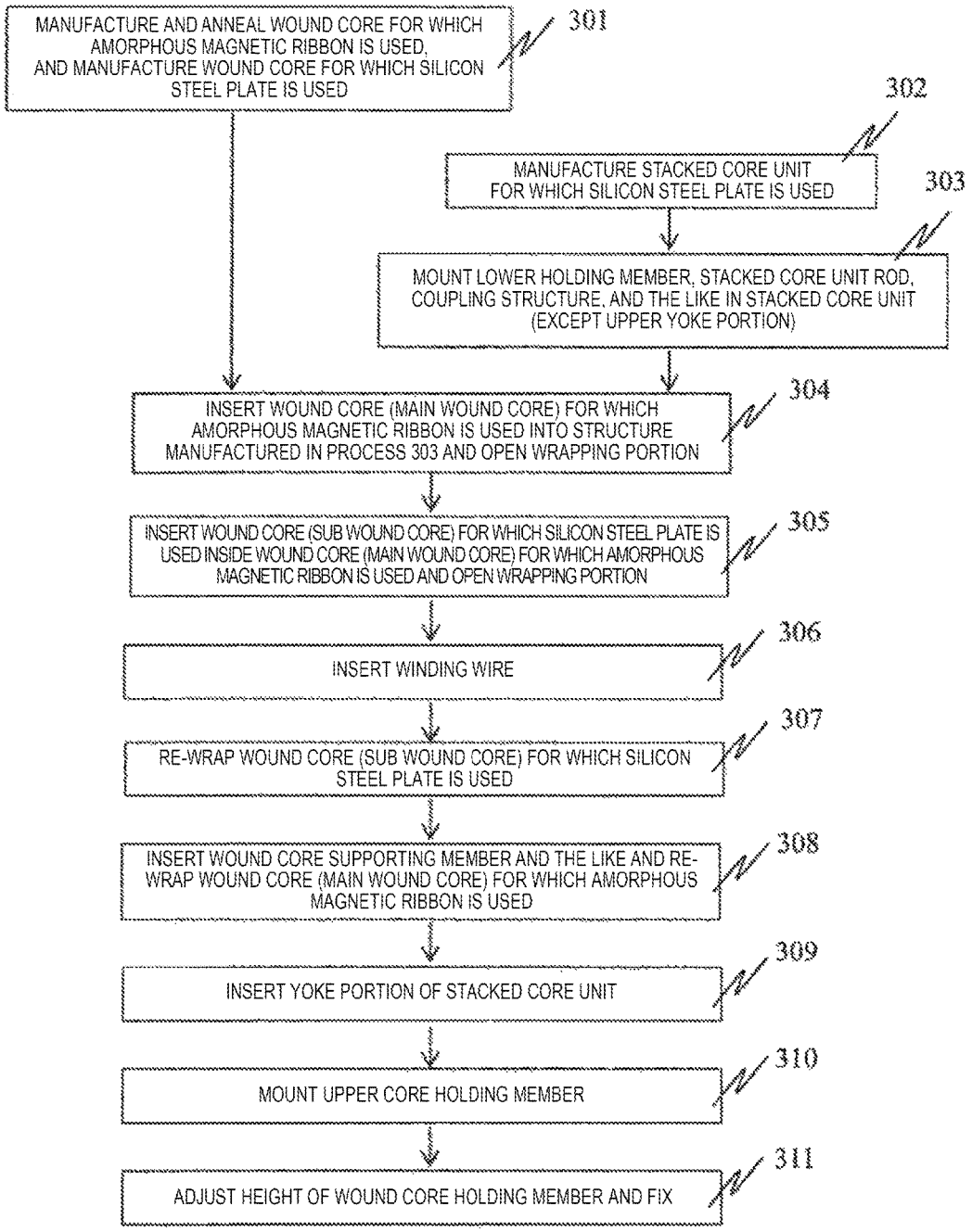

TRANSFORMER

TECHNICAL FIELD

The present invention relates to a transformer in which transformer cores constituted by an amorphous magnetic ribbon and a silicon steel plate are used.

BACKGROUND ART

In response to increasing awareness of the global warming problem in recent years and the rapid increase of the demand of electric power due to rapid economic development in some regions, interest in reduction of loss, particularly, reduction of iron loss (non-load loss) in a transformer increases.

An amorphous magnetic ribbon is practically used as a transformer for distribution using the fact that the non-load loss of the amorphous magnetic ribbon is ⅓ to ¼ of a directional silicon steel plate. A core called a wound core which is formed by winding a magnetic ribbon is generally used for a transformer for which the amorphous magnetic ribbon is used.

However, the wound core of the magnetic ribbon has lower stiffness and is more difficult to be fixed than a stacked core formed by stacking silicon steel plates. Further, if a force applied to the wound core increases, there is a problem in that iron loss increases. With respect to this problem, various proposals have been made.

As a background art of this technical field, there is JP-A-05-144646 (PTL 1). This publication discloses a transformer core which is a wound core constituted by an amorphous magnetic ribbon, has a protecting material constituted by a silicon steel plate attached to peripheries thereof, and is supported by an upper metal fitting and a lower metal fitting.

Also, there is JP-A-62-238612 (PTL 2). This publication discloses a transformer core which is formed by winding an amorphous magnetic ribbon around a winding frame of a core and has a pair of side plates having a rectangular frame shape disposed so as to surround the core.

Further, there is JP-UM-A-63-15022 (PTL 3). This publication discloses a transformer core which is a wound core constituted by an amorphous magnetic ribbon and is fixed to a side clamp.

CITATION LIST

Patent Literature

PTL 1: JP-A-05-144646
PTL 2: JP-A-62-238612
PTL 3: JP-UM-A-63-15022

SUMMARY OF INVENTION

Technical Problem

Recently, it has been desired to extend the application of an amorphous magnetic ribbon to a large capacity transformer. In order to increase the capacity of the transformer, the weight of a wound core for which the amorphous magnetic ribbon described above is used also increases, and a support method thereof is a problem. In addition, as a support structure of the wound core, a metal support structure is used in order to obtain a sufficient strength, but there is a concern that eddy current may flow in the support structure, and loss is generated, due to leakage magnetic field from the winding wire. Reduction of the loss in the support structure is also a problem.

In the structure of PTL 1, the wound core is supported by the upper metal fitting and the lower metal fitting; however, in a case in which a weight of the wound core increases, a sufficient strength may not be obtained, and a method relating to reduction of loss in the upper metal fitting, the lower metal fitting, and an upper and lower coupling plate is not disclosed.

In the structure of PTL 2, a heavy weight wound core can be held by a pair of side plates in a frame shape, but reduction of loss of the side plates is not disclosed.

In the structure of PTL 3, the wound core is fixed by the side clamps; however, in a case in which the weight of the wound core increases, a sufficient strength may not be obtained, and means for reducing the loss in the side clamp is not disclosed.

Also, in a large capacity inner iron type transformer, a circular winding wire is generally used in order to ensure compact insulation and sufficient mechanical force likelihood. At this time, a cross-sectional shape (horizontal cross-section including winding wire) of the core is desirably as close to a circular shape as possible. That is, it is another problem to make a core space factor (a ratio of an actual core cross-sectional area with respect to a cross-sectional area of a circular shape) close to one as much as possible.

The invention has been made in terms of the above problems, and an object of the invention is to provide a transformer core which is a core for a large capacity transformer, and has a support structure that does not apply an excessive force which increases iron loss in a wound core in the wound core formed by winding the amorphous magnetic ribbon, in which loss in the support structure is small and a high core space factor may be obtained.

Solution to Problem

In order solve the above-described problems, a transformer of the invention includes a core which includes a main leg, a side leg, and a yoke, and a winding wire (5) which is wound around the main leg of the core, inside a tank (40) which is filled with an insulating medium, the main leg of the core includes a main wound core (1) having a square cross-section which is formed by winding the amorphous magnetic ribbon and a sub wound core (2) constituted by silicon steel plates which are stacked with curvatures provided at four sides thereof, and a cross-section of a part, where the winding wire (5) is disposed, in the main leg is approximately a circular shape.

Advantageous Effects of Invention

According to the invention, an increase in the iron loss can be suppressed at a low level even in the transformer in which a large amorphous magnetic ribbon wound core is used. In addition, since a stacked core unit is formed by staking silicon steel plates, loss generated due to leakage magnetic flux can be suppressed to be low. Further, the space factor of the core can be increased (that is, the space factor can be set to be close to one), and an economical transformer can be provided by reducing costs of electric wires.

BRIEF DESCRIPTION OF DRAWINGS

FIG. 1 is a horizontal sectional view illustrating a schematic structure of a transformer in a first example.

FIG. 2 is a side view illustrating a stacked core unit which is formed by stacking silicon steel plates in the first example.

FIG. 3 is a vertical sectional view illustrating a schematic structure of a wound core in the first example.

FIG. 4 is a horizontal sectional view illustrating a fixing method of the stacked core unit and a support structure of the wound core in the first example.

FIG. 5 is a view illustrating a holding member of the wound core in the first example.

FIG. 6 is a vertical sectional view illustrating a detailed support structure of the wound core in the first example.

FIG. 7 is a horizontal sectional view illustrating a partition structure in the first example.

FIG. 8 is a vertical sectional view illustrating the partition structure in the first example.

FIG. 9 is a flow chart illustrating a manufacturing and assembling method of main portions of the transformer in the first example.

DESCRIPTION OF EMBODIMENT

Hereinafter, an example will be described with reference to drawings. Also, following description is only an example, and a content of the invention is not intended to be limited to a specific aspect as follow. The invention itself can be modified into various aspects within a range where disclosure of claims is satisfied.

Example 1

In this example, an example of an oil-filled single phase transformer will be described.

FIG. 1 is a horizontal sectional view illustrating a schematic structure of a transformer according to Example 1. A core of the transformer of the example is configured with a main wound core 1 which is formed by winding an amorphous magnetic ribbon, a sub wound core 2 which is formed by winding a silicon steel plate cut in a predetermined width, and a pair of stacked core units 3 which is formed by stacking silicon steel plates on both sides of a side surface of the main wound core 1 in a frame shape, that is, in a tiered shape in a misaligned manner in a state of being provided with curvatures.

According to a configuration described above, a main leg of the core of the example is configured with the main wound core 1 having a square cross-sectional shape which is formed by winding the amorphous magnetic ribbon and the silicon steel plates which are stacked with curvatures provided at four sides thereof, and a cross-section of a part, where a winding wire 5 is disposed, in the main leg is approximately a circular shape.

In FIG. 1, the main leg (which is configured with the main wound core 1 constituted by C1 to C4, the sub wound core 2, and the stacked core unit 3) is provided in the center, and side legs (which are configured with the main wound core 1 constituted by C1 and C2 or C3 and C4, the sub wound core 2, and the stacked core unit 3) are provided on both sides of the main leg. The winding wire 5 is disposed around of the main leg. It is not illustrated in FIG. 1; however, a part, which connects the main leg with the side legs, constitutes a yoke (refer to FIG. 2 and FIG. 3).

Also, in FIG. 1, the main wound core 1 is constituted by two amorphous magnetic ribbons such as C1 and C2 (or C3 and C4), but this configuration is made in consideration of workability in a case in which the transformer is large, and one core may also be constituted by one amorphous magnetic ribbon.

The winding wire 5 is disposed so as to surround a main leg portion of the main wound core 1 and the sub wound core 2. The winding wire 5 is omitted in the drawings, but is constituted in a cylindrical shape by a primary winding wire and a secondary winding wire which are concentrically wound. The core and the winding wire 5 are accommodated in a tank 40, and mineral oil 50 for insulating and cooling is injected to the inside of the tank. In description as follow, description of the tank and the mineral oil will be omitted.

FIG. 2 is a side view illustrating the stacked core unit 3 which is formed by stacking the silicon steel plates. The stacked core unit 3 is formed by stacking the silicon steel plates which are cut into a predetermined shape, and has a frame-shaped structure, that is, is in a state in which the plates are stacked in a tiered shape in a misaligned manner and curvatures are provided.

The stacked core unit 3 is configured with a stacked core unit main leg portion 31, a stacked core unit yoke portion 32, and a stacked core unit side leg portion 33. The winding wire 5 is wound around the stacked core unit main leg portion 31. A horizontal cross-sectional shape of the stacked core unit 3 is approximately a circle shape, and it is effective on improvement of a space factor of the core.

FIG. 3 is a vertical sectional view illustrating a schematic structure of the wound core (cross-section taken along line III-III of FIG. 1). The sub wound core 2 is disposed around the winding wire 5, and the main wound core 1 is disposed on outer peripheries of the sub wound core 2. The main wound core 1 in the cross-section taken along line III-III is a race track shape, but a horizontal cross-section (cross-section taken along line I-I) of FIG. 3 is a square shape (refer to FIG. 1).

It is omitted in the drawings; however, a wrap portion is provided on the main wound core 1 and the sub wound core 2. At the time of installing the winding wire, a work is carried out in which the entire wrapping corresponding to the main wound core 1 and the sub wound core 2 is opened, the winding wire is inserted, and then the entire wrapping is closed.

Next, a fixing method of the stacked core unit 3 or a support method of the main wound core 1 will be described. FIG. 4 is a horizontal sectional view illustrating the fixing method of the stacked core unit and a support structure of the wound core. FIG. 5 is a view illustrating a holding member of the wound core. FIG. 6 is a vertical sectional view illustrating detail of the support structure of the wound core.

The stacked core unit main leg portion 31, the stacked core unit side leg portion 33, and the stacked core unit yoke portion 32 on a lower portion of the stacked core unit 3 are fixed to a lower core holding member 7 and a leg holding member 4 using stacked core fixing members 11 (for example, bolt or the like) as illustrated in FIG. 6.

A pair of the stacked core units to which a predetermined structure is added is a structure capable of supporting a heavy load using a stacked core unit rod 8, a coupling structure 9, and a partition structure 10. Also, a pressboard (not illustrated) is provided on a main winding wire side of the coupling structure 9, and mechanically protects the main wound core 1 which is made of a mechanically fragile amorphous material.

As illustrated in FIG. 6, upper core holding members 6 are fixed on the stacked core unit rod 8. The stacked core unit yoke portion 32 on an upper portion is disposed between a pair of the upper core holding members 6, and the stacked core unit yoke portion 32 on the upper portion can be strongly fixed by being tightened using an upper core holding member fixing portion 61 (refer to FIG. 4). In addition, the upper core holding members 6 hold an upper portion of the main wound core 1 to be sandwiched through the stacked core unit yoke portion 32 on the upper portion.

As illustrated in FIGS. 4, 5, and 6, a holding member overhanging portion 12 is provided on the upper core holding member 6, and a wound core holding member 20 is fixed to the holding member overhanging portion 12 through each member (to be described later in detail). Also, a height adjusting mechanism 23 is provided on the holding member overhanging portion 12, and is capable of adjusting a height position of the wound core holding member 20.

As illustrated in FIG. 5, the wound core holding member 20 is fixed to the holding member overhanging portion 12 provided on the upper core holding member 6 through a horizontal fixing member 21 and a vertical fixing member 22. The height position of the wound core holding member 20 is adjusted by the height adjusting mechanism 23 so that iron loss of the main wound core is reduced, and then is fixed to a desired position. The wound core holding member 20, the horizontal fixing member 21, and the vertical fixing member 22 are manufactured using a non-magnetic material, and generation of loss due to eddy current is suppressed.

The wound core holding member 20 is disposed inside the main wound core 1 for which the silicon steel plate is used, supports the main wound core 1 in a state in which the main wound core 1 is hung. In this way, since an excessive tightening force is not applied to the main wound core 1 made of an amorphous material, iron loss generated in the core can be reduced.

In the cross-section taken along line III-III of FIG. 1, two wound cores (C2 and C4) are adjacent to the main wound core, but the partition structure 10 is provided between the two main wound cores in order to improve characteristics of protection and cooling of the core (refer to FIG. 4).

FIG. 7 is a horizontal sectional view illustrating the partition structure 10, and FIG. 8 is a vertical sectional view thereof. In the partition structure 10, vertically long partition vertical structures 102 are provided with a constant interval at both sides of one of partition horizontal structures 101 which are disposed with a constant interval, and a pressboard 103 is provided on the wound core side of the partition vertical structure 102. According to this structure, a cooling flow passage is formed between the adjacent main wound cores, and thus the core can be sufficiently cooled.

Next, a manufacturing and assembling method of the transformer of the example will be described. FIG. 9 is a flow chart illustrating the manufacturing and assembling method of main portions of the transformer.

First, the wound core which is formed by repeatedly winding a plurality of the amorphous magnetic ribbons is manufactured, and annealing is performed thereon. Moreover, the silicon steel plate is cut into a predetermined size and is wound, and thus the wound core is manufactured (301). The wound core for which the amorphous magnetic ribbon is used becomes the main wound core 1, and the wound core for which the silicon steel plate is used becomes the sub wound core 2.

Meanwhile, the silicon steel plate is cut into a predetermined size and stacked in a frame shape as illustrated in FIG. 2, and thus the stacked core unit 3 is manufactured (302). Further, except an upper yoke portion, the lower holding member 7, the stacked core unit rod 8, the coupling structure 9, and the like are mounted on the stacked core unit 3 (303).

The main wound core 1 is inserted into the structure manufactured in a process 303, and the wrap portion thereof is opened (304). Further, the sub wound core 2 is inserted into the main wound core 1 in which the wrap portion is opened, and the wrap portion thereof is opened (305). After that, the winding wire 5 is inserted (306).

Next, the wrapping which is opened of the sub wound core 2 is closed (307), the wound core holding member 20 is inserted into the main wound core 1, and then the open wrapping is closed (308).

After that, the silicon steel plate which is cut into a predetermined size is inserted into the yoke portion of the stacked core unit 3 (309). Further, the upper core holding member 6 (refer to FIG. 6) is mounted (310).

The wound core holding member 20 is fixed at a position where iron loss of the main wound core 1 constituted by the amorphous magnetic ribbon is minimized, by adjusting a height of the wound core holding member using the height adjusting mechanism 23 provided in the holding member overhanging portion 12 of the upper core holding member 6 (311).

According to the example, since a horizontal cross-sectional shape of the main wound core, the sub wound core, and the stacked core unit surrounded by the winding wire in a cylindrical shape is approximately a circular shape, there is an effect that the core space factor is improved approximately 25%, when compared to a case of forming a core in which a plurality of the wound cores for which the amorphous magnetic ribbon is used are combined (case of horizontal cross-section in square shape).

Further, it is known that noise of the wound core for which the amorphous magnetic ribbon is used is slightly large, when compared to a case of the core for which only the silicon steel plate is used; however, in the structure of the example, since most of the wound core for which the amorphous magnetic ribbon is used is covered with a silicon steel plate stacked core unit, there is an advantage that noise can be reduced, when compared to a case in which the core is constituted by only the wound core for which the amorphous magnetic ribbon is used.

In the example, the sub wound core 2 is constituted by the silicon steel plate, but the sub wound core 2 may be constituted by the amorphous magnetic ribbon depending on a size of the core. In this case, there is an advantage that iron loss can be reduced when compared to a case in which the silicon steel plate is used. Also, in the example, the single phase transformer has described, but the example also can be applied to a three-phase transformer.

REFERENCE SIGNS LIST

1 main wound core
2 sub wound core
3 stacked core unit
4 leg holding member leg holding member
5 winding wire
6 upper core holding member
7 lower core holding member
8 stacked core unit rod
9 coupling structure
10 partition structure
11 stacked core fixing member
12 holding member overhanging portion
20 wound core holding member
21 horizontal fixing member
22 vertical fixing member
23 height adjusting mechanism
31 stacked core unit main leg portion
32 stacked core unit yoke portion
33 stacked core unit side leg portion
40 tank

50 mineral oil
61 upper core holding member fixing portion
101 partition horizontal structure
102 partition vertical structure
103 pressboard

The invention claimed is:

1. A transformer comprising, inside a tank:

a core that includes a main leg, a side leg, an upper yoke, and a lower yoke; and a winding wire that is wound around the main leg of the core, wherein the main leg of the core includes a main wound core having a square cross-section which is formed by winding an amorphous magnetic ribbon, and silicon steel plates which are stacked at four sides of the main wound core, wherein the silicon steel plates include a pair of stacked core units of the silicon steel plates arranged on opposite side surfaces of the main wound core in a tiered shape in which a width of the silicon steel plates decreases as a distance from the main wound core increases, and wherein a cross-section of a part, where the winding wire is disposed, in the main leg is approximately a circular shape.

2. The transformer according to claim 1, wherein the core includes the main wound core, a sub wound core which is constituted by a silicon steel plate wound around an inner circumference side of the main wound core, and the pair of stacked core units.

3. The transformer according to claim 2, wherein the stacked core unit which is disposed on each of the main leg, the side leg, and the lower yoke is held by a holding member.

4. The transformer according to claim 3, wherein the stacked core unit provided in the upper yoke is held by the holding member.

5. The transformer according to claim 4, wherein a support member which supports the main wound core is included in the holding member provided in the upper yoke.

6. The transformer according to claim 5, wherein the support member includes a height adjusting mechanism which adjusts a height of the main wound core.

* * * * *